US008203505B2

(12) United States Patent
Kuiken et al.

(10) Patent No.: US 8,203,505 B2
(45) **Date of Patent: *Jun. 19, 2012**

(54) INFORMATION PRESENTATION DEVICE

(75) Inventors: Martijn Kuiken, AZ Veendam (NL); Erwin Weinans, PH Klijndijk (NL); Dick de Jong, BW Emmen (NL)

(73) Assignee: Sony Ericsson Mobile Communications AB, Lund (SE)

( * ) Notice: Subject to any disclaimer, the term of this patent is extended or adjusted under 35 U.S.C. 154(b) by 909 days.

This patent is subject to a terminal disclaimer.

(21) Appl. No.: 12/256,955

(22) Filed: Oct. 23, 2008

(65) Prior Publication Data

US 2010/0103079 A1 Apr. 29, 2010

(51) Int. Cl.
*G09G 3/00* (2006.01)

(52) U.S. Cl. ..... 345/31; 345/157; 345/649

(58) Field of Classification Search ..... 345/31, 345/169, 649, 156–158

See application file for complete search history.

(56) References Cited

U.S. PATENT DOCUMENTS

2006/0262143 A1* 11/2006 Harris ..... 345/649
2006/0262144 A1* 11/2006 Harris ..... 345/649
2007/0035564 A1* 2/2007 Katsuyama ..... 345/649
2007/0157084 A1* 7/2007 Yano et al. ..... 715/527
2009/0002270 A1* 1/2009 Chui ..... 345/31
2009/0002272 A1* 1/2009 Chui ..... 345/31
2009/0002273 A1* 1/2009 Chui ..... 345/31
2009/0141045 A1* 6/2009 Jackson ..... 345/649
2009/0251406 A1* 10/2009 Seibert et al. ..... 345/156
2010/0103080 A1* 4/2010 Kuiken et al. ..... 345/31

* cited by examiner

*Primary Examiner* — Kimnhung Nguyen

(74) *Attorney, Agent, or Firm* — Renner, Otto, Boisselle & Sklar, LLP

(57) ABSTRACT

The present invention relates to a method and a device for presentation of content-rich information portions and content-poor information portions, such as list type information on a display. The method performs obtaining of information for presentation on an information presentation unit, monitors a rotational motion around an axis of rotation of an information presentation device, monitors the position of a seam of the information presentation unit, and presents information on the information presentation unit in dependence of the monitored rotational motion and in dependence of the monitored position of the first and second ends, such that content-rich information is presented on the information presentation unit and that content-poor information is presented across the first and second ends of the information presentation unit.

11 Claims, 7 Drawing Sheets

800
802

8
7
6
5
4
3
2
1
804

926
930
924
928
916

918
920
922
934
938
932
936

902
904
906
912
914
910
908

950
954
948
952
940

946
944
942
958
956
962
960

INFORMATION PRESENTATION DEVICE

TECHNICAL FIELD

The present invention relates in general to a device and a method for presentation of information and in particular to a device and a method for presentation of information in dependence of changes in rotation of an information presentation device.

BACKGROUND

Information presentation units, such as displays, are comprised in a large variety of portable electronic devices, such as mobile phones.

The size of mobile phones has roughly decreased over the past years, whereas the size of the information presentation units has increased.

An alternative to presenting information on a large singular display is to present information on two or more displays. In mobile phones, this has been applied by using for instance a top and a bottom side of a mobile phone.

However, there is a demand for even larger displays or screens for presentation of information.

Another alternative to the provision of larger displays is to provide phones that have two parts that can be slid in relation to one another, by which practically the entire surface of an upper part may be provided as a display. In this way buttons can be provided in the lower part, making practically all space of the upper part available for the display.

Nevertheless, there is a demand to provide alternative solutions to the problem of presenting information on portable electronic devices.

SUMMARY

The present invention is directed towards providing an alternative method and device for presenting information to a user.

According to an aspect of the present invention, there is provided an information presentation device for presentation of information, the information presentation device comprising at least one information presentation unit each having a first end and a second end, wherein the first and second ends are provided opposite to each other, and wherein the at least one information presentation unit is arranged to present information to a user, and a presentation controlling unit adapted to be connected to the at least one information presentation unit, said presentation controlling unit being arranged to control the presentation of the information on the at least one information presentation unit in dependence of the position of the first and the second opposing ends of the at least one information presentation unit and in dependence of physical rotation around an axis of rotation of the information presentation device.

Said presentation controlling unit of the information presentation device may further be arranged to determine physical rotation around the axis of rotation of the information presentation device and arranged to provide the presentation of information in dependence of the determined rotation.

Said presentation controlling unit of the information presentation device may further be arranged to determine the position on the information presentation unit at which information pieces are to be presented, in dependence of the detected physical rotation of the information presentation device and in dependence of the position of the first and the second opposing end of the at least one information presentation unit.

The information to be presented by the information presentation device may comprise at least one content-rich information portion and at least one content-poor information portion.

Said presentation controlling unit of the information presentation device may be arranged to determine the position on the information presentation unit, at which position the at least one content-rich information portion of the information is to be presented, in dependence of the detected physical rotation of the information presentation device and in dependence of the position of the first and the second opposing end of the at least one information presentation unit.

Said presentation controlling unit of the information presentation device may be arranged to determine the position on the information presentation unit, at which position the at least one content-poor information portion of the information is to be presented, in dependence of the detected physical rotation of the information presentation device and in dependence of the position of the first and the second opposing end of the at least one information presentation unit.

Said presentation controlling unit of the information presentation device may be arranged to determine the position of the content-rich information portion and the position of the content-poor information portion, in order to present content-rich information portions on the information presentation unit and to position at least one content-poor information portion across the first and second ends of the information presentation unit, in dependence of the detected physical rotation of the information presentation device and in dependence of the position of the first and the second opposing end of the at least one information presentation unit.

Said one of the at least one information presentation unit of the information presentation device may have a substantially rotation symmetric shape around the axis of rotation, wherein the at least one information presentation unit covers at least substantially the entire turn around the envelope surface of the rotation symmetric shape, in which the first and second ends of the at least one information presentation unit defines the substantially entire turn.

Said presentation controlling unit of the information presentation device may be arranged to disclose a position on the information presentation unit in relation to the presented information, at which position the presentation controlling unit is arranged to start presenting information, and arranged to stop presenting presented information, in dependence of the rotation of the information presentation device.

The information presentation device may further comprise a mobile phone.

According to another aspect of the present invention, there is provided a method for controlling presentation of information on at least one an information presentation unit having a first and a second end, where said ends being directed opposite to each other, comprising the steps of obtaining information for presentation on an information presentation unit, monitoring a rotational motion around an axis of rotation of an information presentation device, monitoring the position of the first and second ends of the information presentation unit, and presenting information on the information presentation unit in dependence of the monitored rotational motion and in dependence of the monitored position of the first and second ends, such that content-rich information is presented on the information presentation unit and that content-poor information is presented across the first and second ends of the information presentation unit.

The presentation of information on cylindrical information presentation units that substantially cover the entire turn is provided in a way such that the seam does not interfere with the presented information. It is an advantage that display seams must not disturb the presented information, according to a number of embodiments of the present invention.

Another advantage of at least some embodiments of the present invention is an improved visual experience of the information to be presented, avoiding disturbance from the seam where two ends of the information presentation unit(s) meet.

In the case of a cylindrical information presentation device comprising several information presentation units, for instance by using non-flexible and non-bendable information presentation units, providing several seams, it is an advantage to present in the information dependent on the positions of respective seam such that content-poor information portions cover the seams, providing an effect of "hiding" the seams for a user.

It should be emphasized that the term "comprises/comprising" when being used in the specification is taken to specify the presence of the stated features, integers, steps or components but does not preclude the presence or addition of one or more other features, integers, steps or components or groups thereof.

BRIEF DESCRIPTION OF THE DRAWINGS

In order to explain the invention and the advantages and features thereof in more detail, embodiments will be described below, references being made to the accompanying drawings, in which.

DETAILED DESCRIPTION

When presenting information of a display or a screen, especially when presenting information with portions of content-rich information and portions with content-poor information, such as list type information that may be in the form of text information, the information presentation device according to a number of embodiments of the present invention provides a valuable tool, as an alternative to the displays and screens known today.

With reference to the figures as presented above, a few embodiments of the present invention are now explained.

Figure 1:
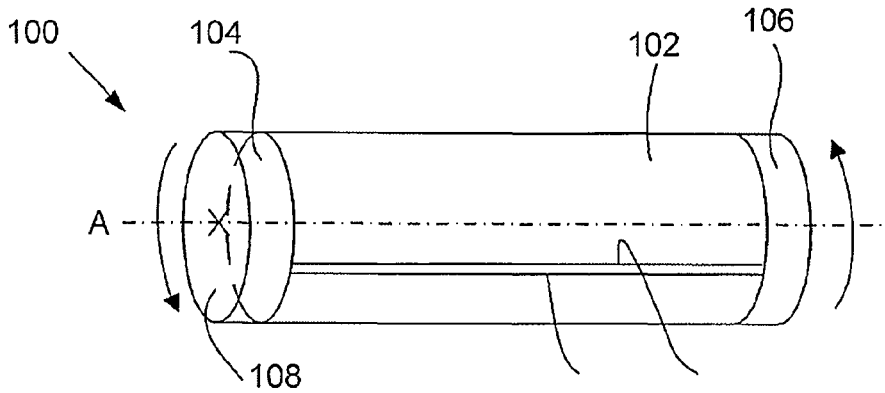
FIG. 1 illustrates an information presentation device according to some embodiments of the present invention.

In FIG. 1 an information presentation device 100 according to some embodiments is illustrated, which information presentation device comprises at least one information presentation unit 102. The information presentation unit may be a display or a screen. In addition, a user input unit and a grip area, marked as 104 and 106, respectively, may also be comprised in the information presentation device 100.

The user input unit may be realized as a push key, as a slidable key or switch, as a wheel or in any other way.

The user input unit 104 may also function as a grip area, and the grip area 106 may alternatively also comprise a user input unit.

The information presentation device, viewed along the axis of rotation is presented as 108.

The information presentation device is suitable for presentation of content-rich and content-poor information portions, such as list type information. Content-rich information portion may be regarded as the list items, and the content-poor information portions may be regarded as space in-between said items.

Another example of content-rich and content-poor information portions, may be text lines with line spacing provided between the text lines.

However, other types of information may also be presented on the information presentation device, such as continuous information such as pictures or videos.

Rotation around an axis of rotation of the information presentation device may trigger an update of the information as presented on the display, being an example of the information presentation unit.

The information presentation unit typically covers substantially the entire turn of the information presentation device.

For technical reasons it may be difficult to produce a display covering 100% of a turn, for which reason substantially the entire turn may be provided as an information presentation unit.

According to some preferred embodiments, the information presentation unit being a part of the information presentation device has a cylindrical shape, which information presentation unit may be realised in the form of a display, and may cover substantially the entire turn and may for this reason appear as to be endless when viewing the entire display.

Viewing the display from one side perpendicular to the axis of rotation, in case of a rotation symmetric information presentation device, information can be presented just as reading or viewing a list of information from a white paper sheet. However, since information has to be updated as the device is rotated new information may have to be imported to the displayed section of the list and old information may have to be exported from the displayed section of the list.

According to some examples of an information presentation device, an input and output longitudinal site parallel with the axis of rotation, is defined. The position of this site can be made to depend on rotation around the axis of rotation of the information presentation device.

List type data may be displayed on the information presentation unit. List type data comprises data that may be displayed as a list of items such as text, icons, figures, thumbnails, links, video clips, or the like.

The distance along the circumference of the information presentation unit, between two consecutive items in the list corresponds to the "line spacing" of the list, according to at least some examples.

If rotation equals to or exceeds an angle of one line spacing, the position of the input/output site is updated, such that a new line will appear at one end of the displayed section of the list and one old line of the displayed section of the list can be shifted out of the displayed area.

Figure 2:
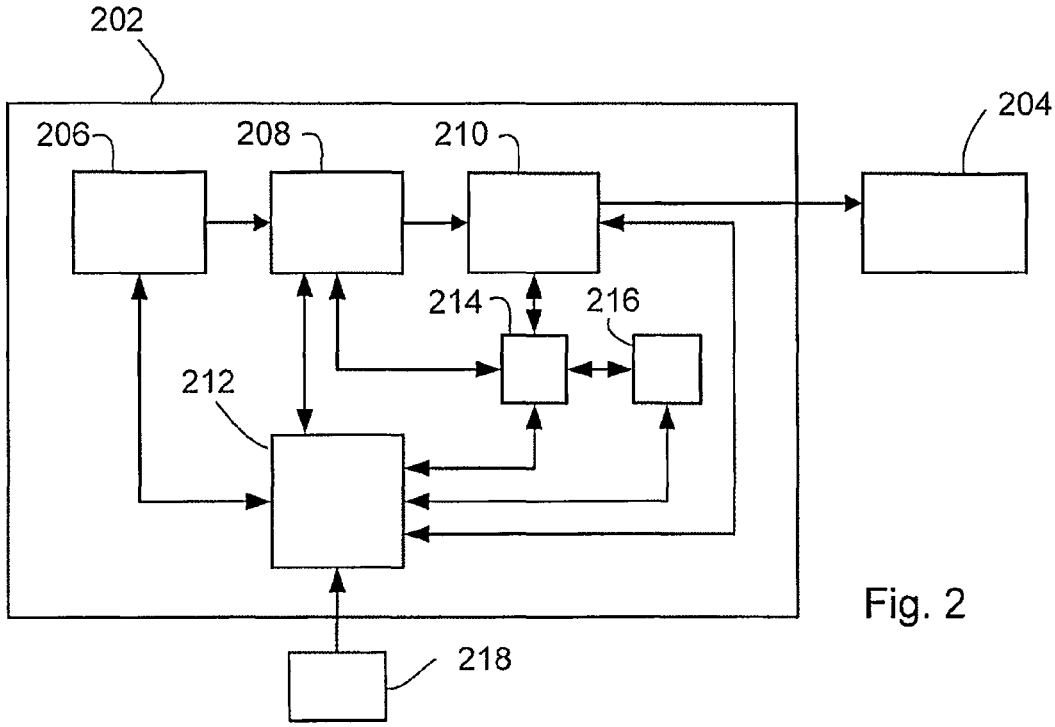
FIG. 2 illustrates a block diagram of a display controlling unit according to some embodiments of the present invention.

With reference to FIG. 2 illustrating a presentation controlling unit 202 connected to a display 204, one example of a unit for controlling the information displayed on the display is now presented.

Rotation around an axis of rotation may be detected by a rotation detection unit 206, which may be realised as a gravitation dependent unit that is arranged to detect rotation around an axis of rotation. In the case the information presentation device has an elongated shape the axis if typically the longitudinal axis.

An angle determining and evaluation unit 208 is provided after the rotation detection unit 206. The angle determining and evaluation unit, which in short may be called the angle unit, may determine the angle of rotation around the axis of rotation and evaluate whether any accumulated angle exceeds an angle of rotation that corresponds to the line spacing of the information as displayed on the display, or not.

The angle unit 208 is further connected to a display controlling unit 210, which further may have a direct connection to the display 204, as presented in FIG. 2.

A memory unit 214 may also be provided in the display controlling device 202 for providing data of the information to be displayed on the display. This memory unit 214 may be connected to the angle unit 208 and to the display controlling unit 210. The display controlling unit may be realized by a display driver unit or the like.

In addition, a control unit 212 may be provided to control the function of the rotation detection unit 206, the angle unit 208, the display controlling unit 210 and the memory unit 214. More over a transceiving unit 216 may also be provided and connected to the control unit 212 as well as to the memory unit 214.

According to some examples a user input unit 218 is also connected to the control unit 212 of the presentation controlling unit 202. This user input unit 218 may be used to activate a method for presenting list type information, such as a list of items or the like, on a display. The user input unit 218 may also be used to activate other display related functions.

Figure 3:
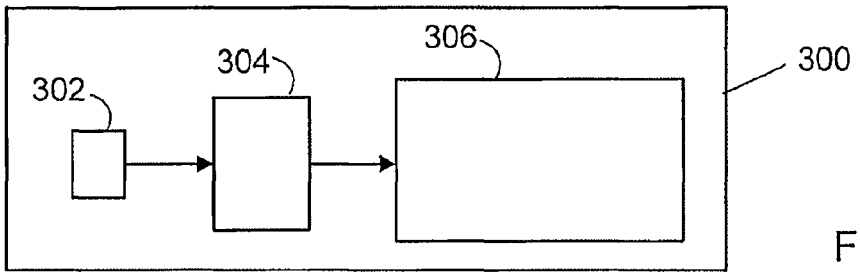
FIG. 3 illustrates an information presentation device according to some embodiments of the present invention.

FIG. 3 further illustrates an information presentation device 300 according to at least some embodiments of the present invention. The information presentation device 300, comprises a user input unit 302 connected to a presentation controlling unit 304, which further may be connected to an information presentation unit 306 such as a display or a screen. According to at least some embodiments, the information presentation unit 306 covers substantially the entire envelope surface of the information presentation device 300, in the case of a rotation symmetrical shape of the information presentation device.

Figure 4:
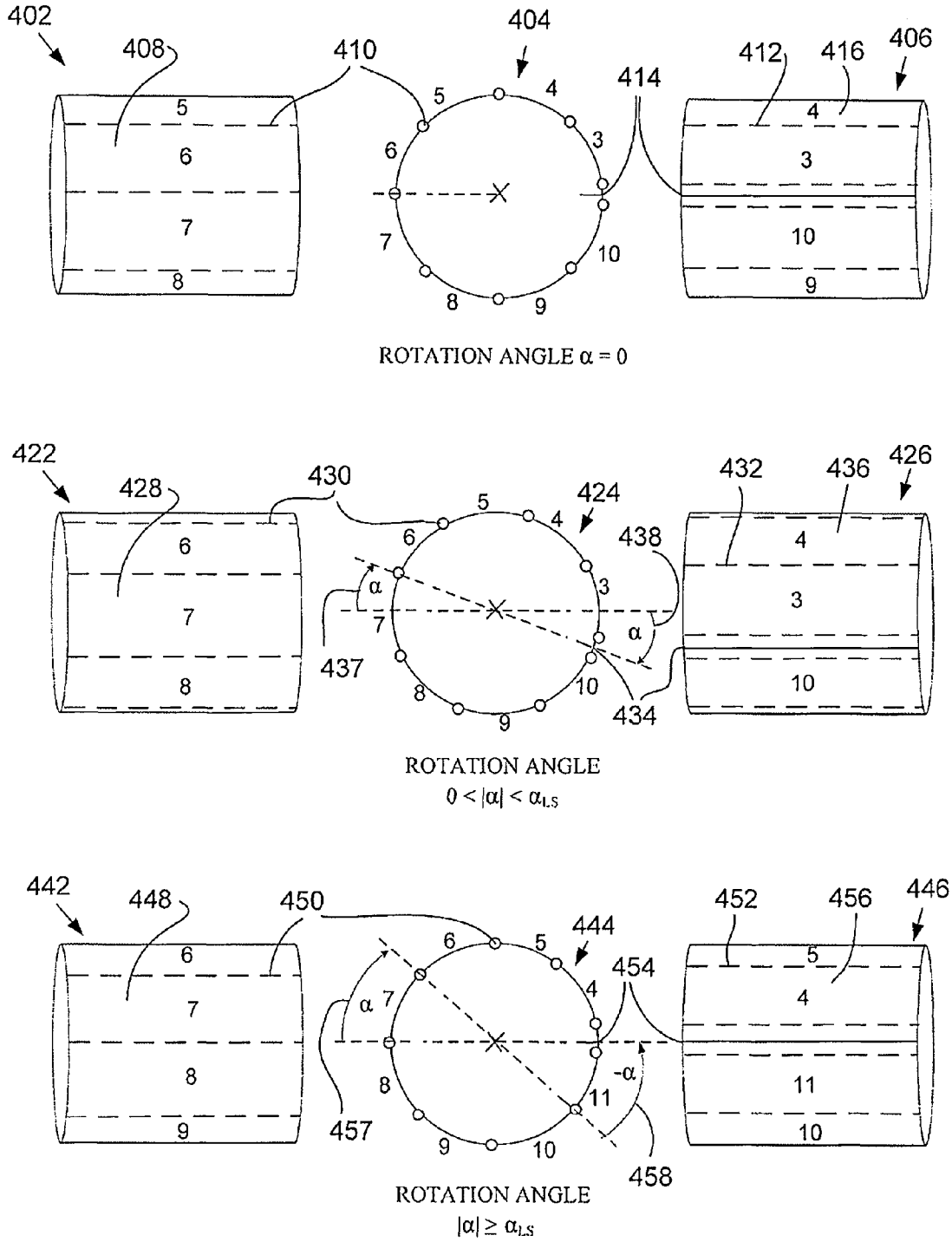
FIG. 4 illustrates an upper, a middle and a lower panel, each presenting one view along an axis of rotation, A, and two views perpendicular to said axis or rotation, A, of an information presentation device, of which the left hand view shows the information presentation device from the left hand side and the right hand view shows the information presentation device from the right hand side.

FIG. 4 illustrates a cylindrical information presentation device presented in three panels; an upper panel, a middle panel and a lower panel, where each panel presents the cylindrical information presentation device at one specific rotation angle, $\alpha$. The cylindrical information presentation device is thus presented at three different rotation angles. The upper panel illustrates views of the information presentation device at a rotation angle $\alpha=0$.

This figure is to visualize updating of information on the information presentation unit in dependence of rotation around an axis of rotation.

To the left is displayed a view 402 perpendicular to the longitudinal axis from the left, and to the right there is displayed a view 406 perpendicular to the longitudinal axis from the right. The dotted lines of the left 410 and right 412 views indicate line breaks, i.e. the spacing between two consecutive lines. The numbering 3, 4, 5, 6, 7, 8, 9, and 10 denote line information as being representative to list type information, of which items, icons, and thumbnails are only examples of a large variety of items that can be displayed on the information presentation unit.

In the centre of the upper panel there is illustrated an information presentation device 404 viewed essentially along the longitudinal axis. Here the line breaks are indicated with circles 410 separating the consecutive lines from one another.

The site for input and output (I/O) of line information 414 on the display is indicated on the left hand side of the centre representation and thus also appears on the right hand side view of the information presentation device 406. It should be emphasized that this site is merely a line or a position at which the information as presented on the display may be shifted in and shifted out.

As the list type information is presented to be displayed from top and downwards on one side of the information presentation device that does not comprise the I/O site, the information as displayed near the I/O site is displayed upside down, as well as being discontinuous since the I/O site itself creates the context discontinuity.

The I/O site may not be clearly visible in case the information as displayed is presented such that the height of the display or screen, corresponds to an integer number of displayed item lines.

According to some examples, the I/O site may be a position at which information may virtually be shifted out of the display and shifted in to the display, rather than being a physical hard ware display interruption.

Now, as the information presentation device is rotated by for instance a user holding the device in his or her hands and rolling the device to read or view further lines of list type items above or below the current view of the display, the rotation detection unit may detect rotation, which may start monitoring of the angle of rotation.

Rotation of the device enables a person to read or view the entire list material line by line. The updating of information is done not by updating the whole displayed information. The only piece of information that is necessary to update is the information presented around position of the I/O site. Since only two lines of list type data may have to be updated in order to move the I/O site one line spacing distance along the envelope surface, updating is quick. Moreover, the user will appreciate this by that the list type data will typically not jump on the display when reading or viewing the data when rolling or rotating the information presentation device. Instead the list type information appears to be fixed to the screen and therefore steady, which facilitates the reading by becoming less tiresome to a user's eyes when reading. This is in contrast to a normal screen, on which text jumps by one or more lines at a time when scrolling, which clearly becomes tiresome in the long run to a reader.

Now returning to FIG. 4 and the middle panel illustrating three views of an information presentation device at a non-zero rotation angle $\alpha$. The rotation of the device is here smaller than the rotation angle corresponding to one line spacing. This angel is denoted a $\alpha_{LS}$.

As was described for the upper panel, to the left is displayed a view 422 perpendicular to the longitudinal axis viewed from the left, and to the right there is displayed a view 426 perpendicular to the longitudinal axis viewed from the right. Again the dotted lines on the left 430 and right 432 views indicate line breaks, which again are virtual line breaks between two consecutive lines. Thus the numbering 3, 4, 6, 7, 8, and 10 denote line information as being representative to list type information.

In the centre of the middle panel there is illustrated the information presentation device viewed nearly along the longitudinal axis. Here the line breaks are indicated with circles 430 separating the consecutive lines from one another.

In the centre display the angle α is clearly illustrated and shows how the whole information presentation device is rotated an angle α. The line spacing breaks as well as the lines themselves are thus also rotated an angle α along the envelope surface of the display of the information presentation device.

In the view 422 on the left hand side, it can therefore be seen that the lines 6, 7 and 8 have been rotated with respect to the position of the lines 6, 7 and 8 as displayed in the upper panel on the left hand side as shown in view 402.

Similarly, it can be seen the line breaks and the lines 3, 4 and 10 as displayed in the middle panel on the right hand side as shown in view 426 have been rotated with respect of the position as displayed in the upper panel of FIG. 4 on the right hand side view 406.

It is clearly visualised that the I/O site 434 of the display 436 is rotated along with the display a rotation angel α around the longitudinal axis. The I/O site is thus no longer centred on the right hand side view 426 of the middle panel.

The right hand side view 426 shows that for a rotation angle α that is smaller than a rotation angle that corresponds to a line spacing of the list type information, $\alpha_{LS}$ as presented on the display, the position of the I/O site is rotated along with the entire display and no updating of information on the display is performed.

Now, focusing on the lower panel of the three panels displaying an information presentation device at three different views, the information presentation device has been rotated an angle a that at least corresponds to the line spacing angle $\alpha_{LS}$.

The left 442, right 446 and centre 444 views refer to different views of the information presentation device as explained above for the middle and upper panels.

In the centre view 444 is shown that the rotation angle a corresponds to the line spacing rotation angle $\alpha_{LS}$, as the line spacing mark between lines 7 and 8 in view 442 has taken the position of the line spacing mark between lines 6 and 7, as shown in the upper panel, left hand side view 402.

The left hand side view 442 of the information presentation device in the lower panel thus presents further rotated lines, showing information on lines 6, 7, 8 and 9. The position of each of these lines therefore corresponds to the position of the lines 5, 6, 7, and 8 in the upper panel, left hand side view 402.

On the right hand side view 446, the position of the I/O site is now discussed. As the rotation angle of the information presentation device α, corresponds to the line spacing angle $\alpha_{LS}$, a new line, line 11, of information is shifted in to the displayed area at the bottom of the displayed area. In addition, the first displayed line, line 3, is shifted out of the displayed area, bringing line 4 as the new first line of the displayed area. Together with the new line, line 11 being shifted in, the effect is that the I/O site is rotated an angle α in a direction opposite to an increasing angle α along the envelope surface. The angle of rotation of the I/O site in view 444 is therefore minus α, since α may either be a positive angle or a negative angle.

As the position of the input/output (I/O) site is rotated in a direction opposite to increasing angle α, the position on the display of the I/O site may be maintained in the centre of the display.

It should be clarified that the function of rotation of the I/O site may be switched off and again switched on. In a switched off mode, the position of the I/O site is not shifted and the information of the display may not be updated.

As the position of the I/O site is not rotated in the switched off mode, the I/O site can easily be rotated to the side of the display, being one example of the user presentation unit, that is directed away from the user holding the device, before switching on the information presentation device for updating of the display of said information presentation device.

Figure 5A:
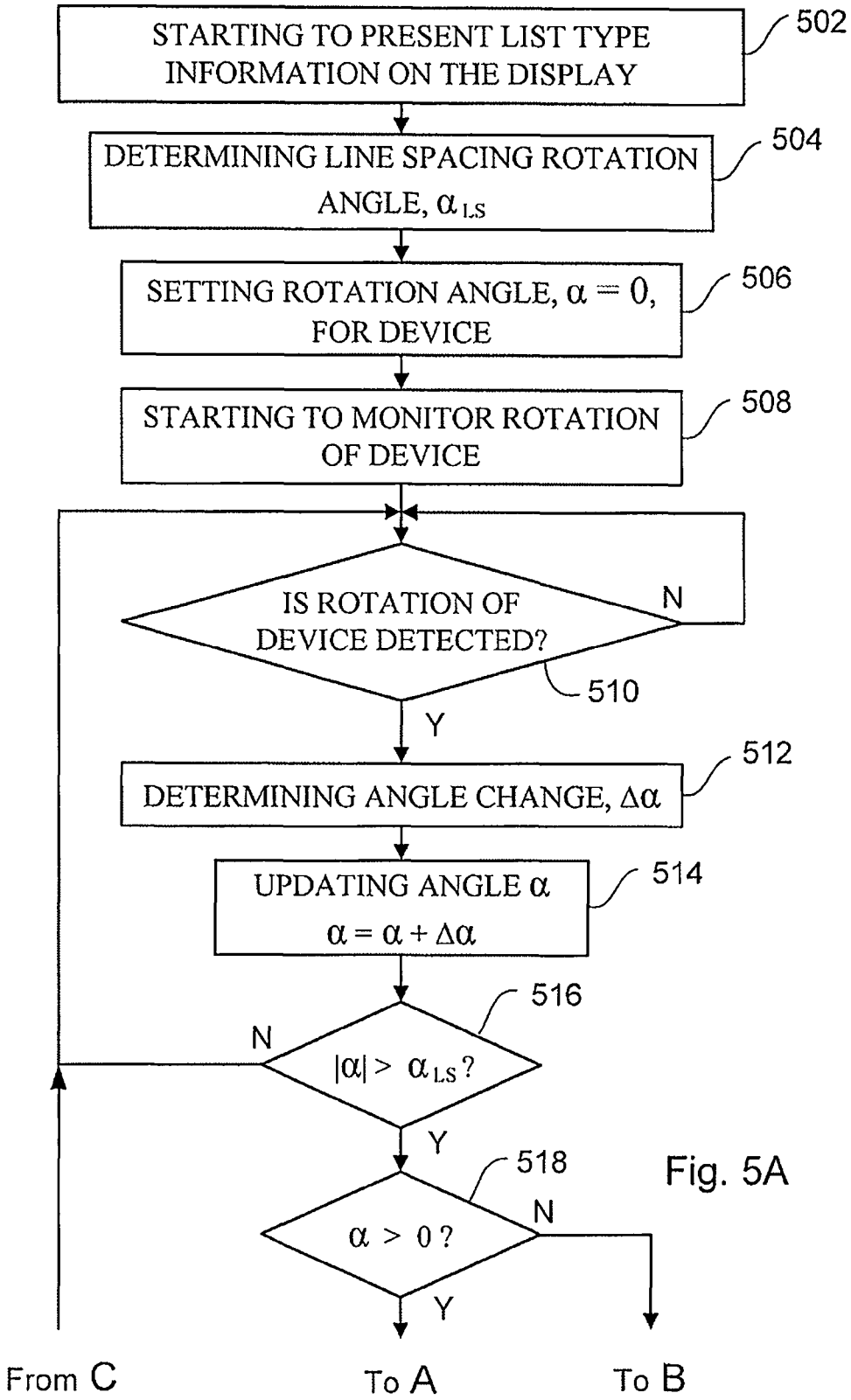
FIGS. 5A and 5B illustrate method steps of a flow chart related updating information for information presentation.
Figure 5B:
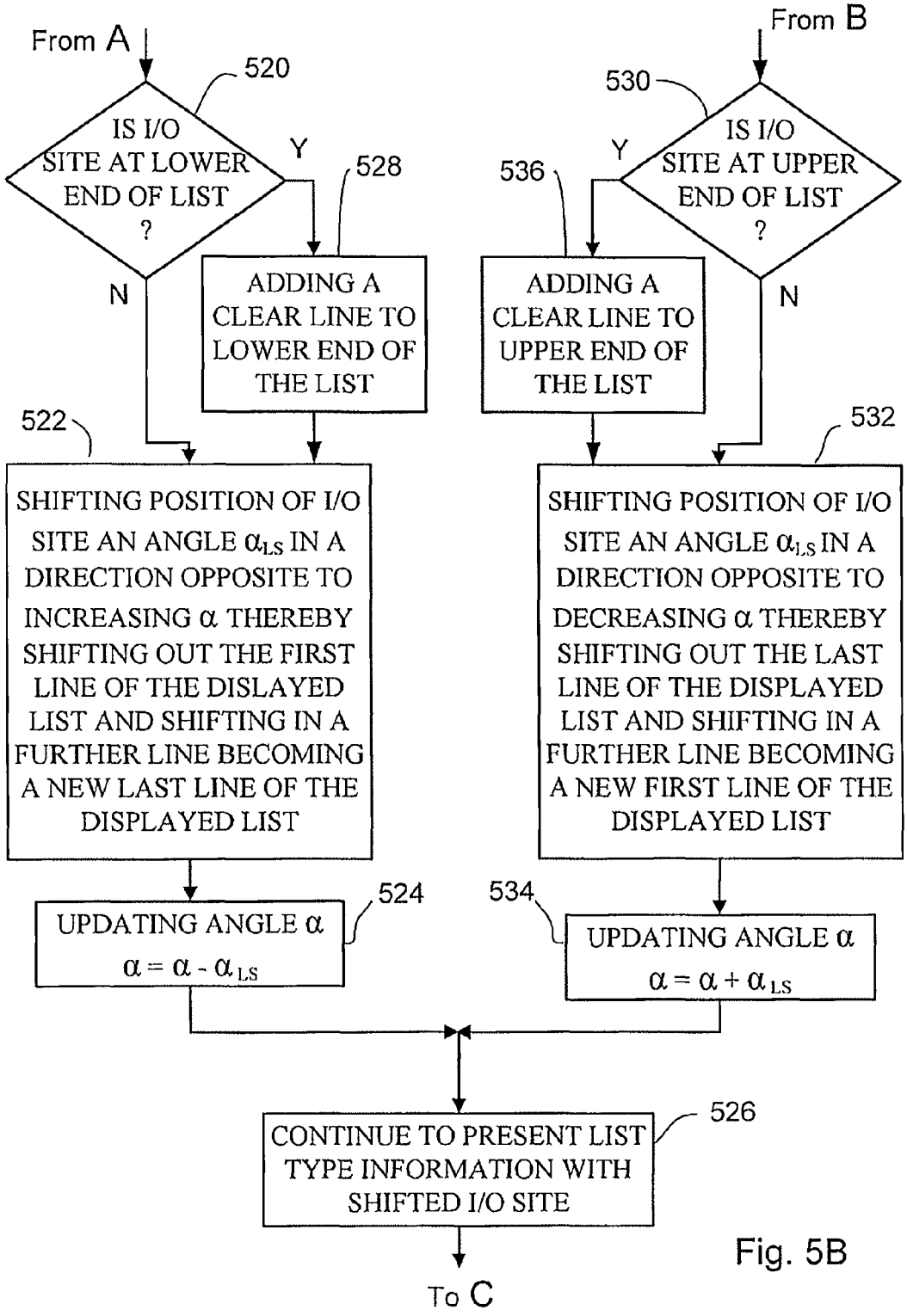

FIGS. 5A and 5B illustrate a method for updating of the position of the I/O site, which is described in more detail below.

According to some examples this method may start with step 502, starting to present list type information on an information presentation unit 102. Here the information presentation unit 102 comprises a display.

When presenting list type information, the rotation angle that corresponds to a line spacing distance along the envelop surface, $\alpha_{LS}$ of the information presentation device is now determined in step 504. This angle $\alpha_{LS}$ is thus the rotation angle that the rotation of one line around the longitudinal axis corresponds.

In the case the list type information comprises text type information, and is displayed with a small font size, the angle $\alpha_{LS}$ becomes relatively small, whereas in the case the font size is large, the angle $\alpha_{LS}$ becomes relatively large.

The following step may the step 506 of setting the rotation angle α=0, i.e. zero, for the information presentation device. The angle α is reset to zero in order to start from a well-defined angle value.

Monitoring of the rotation of the information presentation device is started by step 508. From this step and on, rotation of the device is thus monitored and updating of the information of the display may be performed in dependence of the rotation of the information presentation device around an axis of rotation.

Rotation of the device is detected in the step 510, "Is rotation of device detected?" In the case rotation is detected, the angle change, Δα, that is caused by the rotation is then determined. This is performed in step 512.

In case no angle rotation is detected in step 5 10, it is again determined in the following step whether a rotation is detected in the very same step, step 510, as shown in FIG. 5A.

If, however, a rotation actually is detected in step 510 and the rotation angle change determined in step 512, the angle alpha is updated at step 514, α=α+Δα.

Having updated the angle α, it is determined whether the updated rotation angle corresponds to the distance of a line spacing along the envelope surface of the device, and angle $\alpha_{LS}$. This is performed in step 516 where it is determined whether the absolute value of the angle α is larger than the line spacing angle $\alpha_{LS}$.

Since the information presentation device may be rotated around an axis of rotation in two directions, one being clockwise and the other being counter clockwise around an axis of rotation, it would not be enough to determine whether the information presentation device is rotated an angle that larger than the line spacing angle.

The information presentation device may equally well be rotated in the opposite direction such that the rotation angle $\alpha_{LS}$ becomes smaller than a negative line separation angle.

If the absolute value of the rotation angle $\alpha$ is not larger than the line spacing angle $\alpha_{LS}$, the next step in the method is then detecting whether rotation of the device is detected in step 510.

In the case where the rotation angle is positive and larger than the line spacing angle $\alpha_{LS}$, that is answering Y in step 518, the following step in the method is step 520, as illustrated in FIG. 5B, determining whether the I/O site is positioned at the lower end of entire list, or not.

A positive rotation angle change of the information presentation device is defined as the direction is which the device is rotated when reading from top and downwards of the list type information. Likewise, a negative rotation angle change is defined as the direction in which the device is rotated when reading the information from bottom and upwards.

As explained above, the I/O site is typically a site at which presented information may be shifted out and information to be presented may be shifted in.

The list type information to be displayed in the display, may commence with the top line of the entire list file. This top line equals to the upper end of the list. A corresponding bottom line of the entire list is thus the lower end of the list.

In step 520 it is determined whether the I/O site is positioned at the lower end of the entire list, or not. If the I/O site is not positioned at the lower end of the entire list, meaning that there is additional information to be switched in, the following step is the step at which the position of the I/O site is changed.

According to at least some embodiments, step 522 comprises shifting the position of the I/O site an angle $\alpha_{LS}$ in a direction towards decreasing $\alpha$ angle value. By shifting this I/O site the first line of the displayed list is shifted out. Also, a further line is shifted in becoming a new last line of the displayed list.

Returning to the information presentation device as displayed at three different rotation angles, it is illustrated when comparing the upper panel and the lower panel, that the first line, being line 3, of displayed list of the right hand side view 406 of the upper panel, is switched out and line 11 is shifted in to the displayed area, as illustrated in the lower panel in the right hand side view 446 of FIG. 4.

Having shifted the I/O site position, the angle $\alpha$ is updated in step 524, performing $\alpha=\alpha-\alpha_{LS}$. After the alpha $\alpha$ is updated the next step to execute may be step 526, continuing to present list type information, but now with a shifted I/O site position.

Subsequent to presenting the information on the display with an updated I/O site position, step 510 is performed by determining whether rotation of the device is detected or not.

Returning to FIG. 5B and the case in which the I/O site is positioned at the lower end of the list, there is no additional information to be switched in to the displayed. When the question in step 520 is answered by a "Y", the following step may therefore be step 528 of adding a clear line to the lower end of the list. The list of items is thus prolonged with one clear line or item from below. This is performed in order to avoid presenting the I/O site to the user rotating the information presentation device in step 526, as repetitive shifting of information else could risk displaying the I/O site to the user.

It should be clarified that the clear line is added to the lower end of the list itself, rather than to the information as presented on the information presentation device. The clear line is therefore displayed in the displayed area, after shifting of the I/O site has been performed.

In the case the information presentation device is rotated, by for instance a user, in the direction for which the angle $\alpha$ is negative, that is when rolling or rotating the device around an axis of rotation from the bottom of the display area to the top of the display area, the angle change is negative and the accumulated angle $\alpha$ may become negative in step 518.

Following the alternative B to FIG. 5B, the next step to the performed is determining whether the I/O site is positioned at the upper end of the entire list, in step 530.

In case the I/O site is already positioned at the upper end of the list, as determined in step 530, the following step is adding a clear line to the upper end of the list, in step 536. As described in connection to step 528, the clear line as added to the list itself. The clear line is then shifted into the displayed area in step 532, when the information is updated around the I/O site, in the way as earlier described.

However, if it is determined that the I/O site is not positioned at the upper end of the entire list, the following step is step 532 at which shifting of the I/O site is performed. In this step, shifting is performed in a direction opposite to the direction as described in step 522. In step 532 the I/O site is shifted an angle $\alpha_{LS}$ in a direction opposite to the direction of decreasing angle $\alpha$. The absolute value of the angle $\alpha$ is thus decreased. The last line on the display is thus shifted out. In addition, shifting in of a further line that is becoming a new first line on the display is hence also performed, in step 532.

Having performed the shifting of the I/O position, the angle $\alpha$ is updated in step 534 by updating the angle $\alpha$ by setting $\alpha=\alpha+\alpha_{LS}$.

After the alpha a is updated the following step is to continue presenting the list type information with the shifted I/O site in step 526, as illustrated in FIG. 5B. As explained above, subsequent to step 526 it is again determined whether rotation of the device is detected, or not in step 510, as illustrated in FIG. 5A.

According to an alternative example, the position of the I/O site may be shifted when the absolute value of the angle of rotation is larger than a small part of a full turn, for instance a quarter of a turn.

Moreover, it is realized that the information presentation device can be turned and rotated in any direction, for which reason list displayed close to the I/O site may be turned around to be displayed from top and downwards. The opposite side of the information presentation device, which now does not comprise the I/O site, is then displayed upside down, as only one side at a time may be displayed from top and downwards.

The I/O site is shifted whenever the absolute value of the rotation angle alpha exceeds alpha LS. In the case of the I/O the alpha LS may be the angle corresponding to a singular pixel distance around the circumference of the information presentation device. In the case of the I/O the alpha LS may alternatively related to the distance between two consecutive items displayed on the information presentation unit.

The information presentation device can thus easily be turned again such that displayed information is shown without the presenting the I/O site on the viewed side.

In addition, the information presentation device function as described herein may be inactivated or switched off as indicated above, possibly for presentation of material different from list type material on the display. In a switched off mode, updating of the screen will thus not be performed, as the device will not respond to rotation around any axes.

It should be pointed out that the addition of a clear line, as mentioned above, is merely one example of presenting almost anything to a user. A clear line may be understood as an empty line. The addition of several clear lines may in reality be the addition of a long empty space.

Also, it is the intention that the I/O site remains positioned on the side directed away from the user such that the user cannot see the I/O, upon rotation of the device.

The information as presented on the information presentation unit may be updated on a more continuous basis, as compared to what has been described above. The line spacing distance may be defined as the distance between two consecutive pixels along the circumference or the envelope surface of information presentation device. By shifting information in and out at the I/O site per line of pixels, a "smooth scroll" experience may be provided to a person towards whom the I/O-side of the information presentation device is directed.

With the provision of an information presentation unit that covers substantially an entire turn of a cylindrical information presentation device, the part that is not covered by the information presentation unit may be focussed upon.

For the presentation of information on the information presentation unit, situations in which content-rich information portions such as text lines virtually are interfered by the part that is not covered by the information presentation unit, are to be avoided in order to provide a proper information presentation.

Figure 6A:
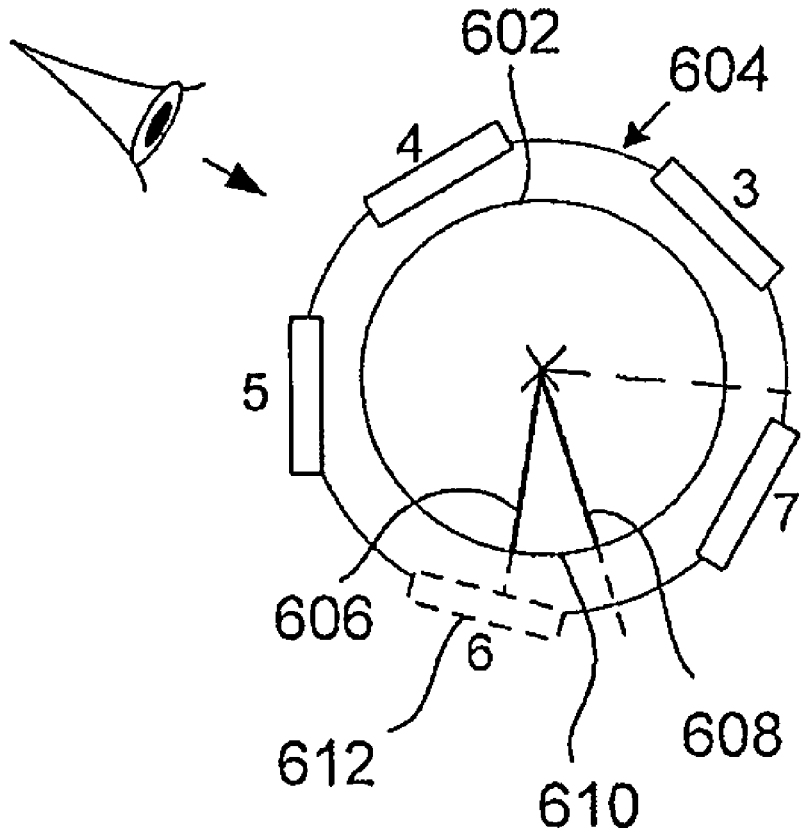
FIGS. 6A and 6B illustrate two views along an axis of rotation of an information presentation device according to some embodiments of the present invention.

A possible overlap situation for the information to be presented and the information presentation unit, where the information presentation unit is shown along an axis of rotation, is presented in FIG. 6A. The envelope surface of the information presentation unit is depicted as 602, and the information to be presented on it as 604. The part that is not covered by the information presentation unit is defined as the first and second opposing ends of the information presentation unit, and are presented as 606 and 608, respectively. The part that is not covered by the information presentation unit may be regarded as a seam of the information presentation unit, and defined between the first and second opposing ends, and therefore depicted as 610 in FIG. 6. As the seam may be regarded as a discontinuity of the information presentation unit, nothing can be actively presented in this region.

In FIG. 6A it is also shown a content-rich information portion to be presented. One such portion is denoted as 612. It is thus clearly illustrated that this portion of content-rich information cannot be displayed with the presented relative orientation of the information and the information presentation device. FIG. 6A is thus an illustration of a situation in which information may have to be shifted along the envelope surface such as to enable content-rich information to be presented on the information presentation unit while avoiding interference by the seam with the presented information.

Figure 6B:
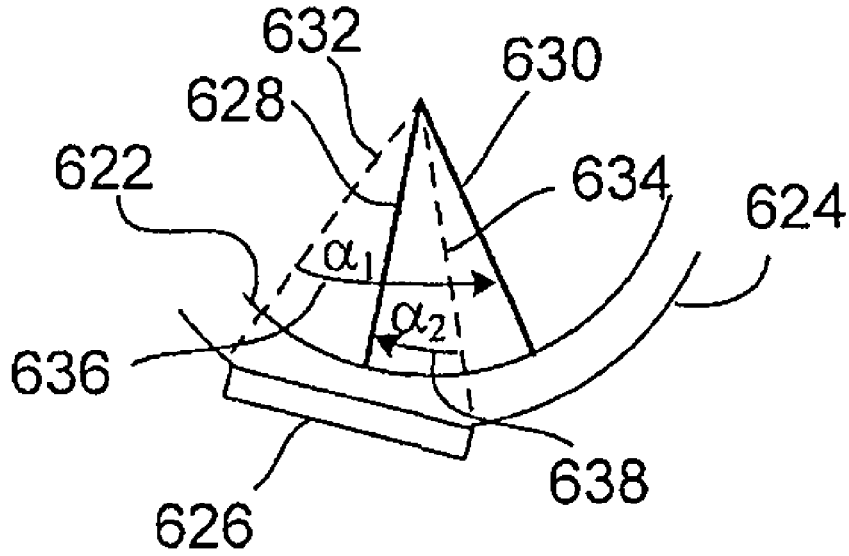

FIG. 6B illustrates an enlarged portion of the FIG. 6A, in which the envelope surface is depicted as 622. The information to be presented is denoted as 624. The seam of the information presentation unit is defined by the region between the first end 628 and the second end 630. The content-rich information portion of the information to be presented on the information presentation unit, such as the display, is denoted by 626. As illustrated in FIG. 6B, the content-rich information portion has a first end 632 and a second ends 634.

Similar to the illustration of FIG. 6A, it is clear from FIG. 6B that the content-rich information portion overlap the seam information presentation unit. To resolve the overlap, shifting of information may have to be performed in order to avoid interference from the display seam with the presented information portion.

Shifting of information along an envelope surface can be performed in either the clockwise or the counter clockwise direction for a cylindrical information presentation device. Two possible ways to resolve the overlap of the display seam and the information thus exist.

For a counter clockwise shifting the information may have to be shifted beyond the display seam, i.e. an angle $\alpha_1$, as defined as the angle between the first end of the content-rich portion 632 and the further end of the seam end further away, 630. For a shifting in the clockwise direction beyond the display seam, the shift angle $\alpha_2$, may be defined as the angle between the second end 634 of the content-rich information portion 626 and the other seam end 628.

In FIG. 6B the illustrated angel $\alpha_2$ is smaller than the angle $\alpha_1$, for which reason a smaller shift would have to be performed when shifting the information in the clockwise direction an angle $\alpha_2$, as compared to shifting in a counter clockwise direction an angle $\alpha_1$.

Shifting the information to be presented an angle $\alpha_2$ along the envelope surface thus resolves the overlap of the seam and the content-rich information portion. This is achieved by providing a content-poor information portion over the display seam. By providing a content-poor information portion, such as a line spacing over the seam, interference from the seam with the information-rich portion is avoided.

The visual impression of the effect of such a shifting of information to be presented is that information is presented on the display as if the seam had not existed. The seam may in this respect be regarded as invisible in relation to the information to be presented.

Figure 7:
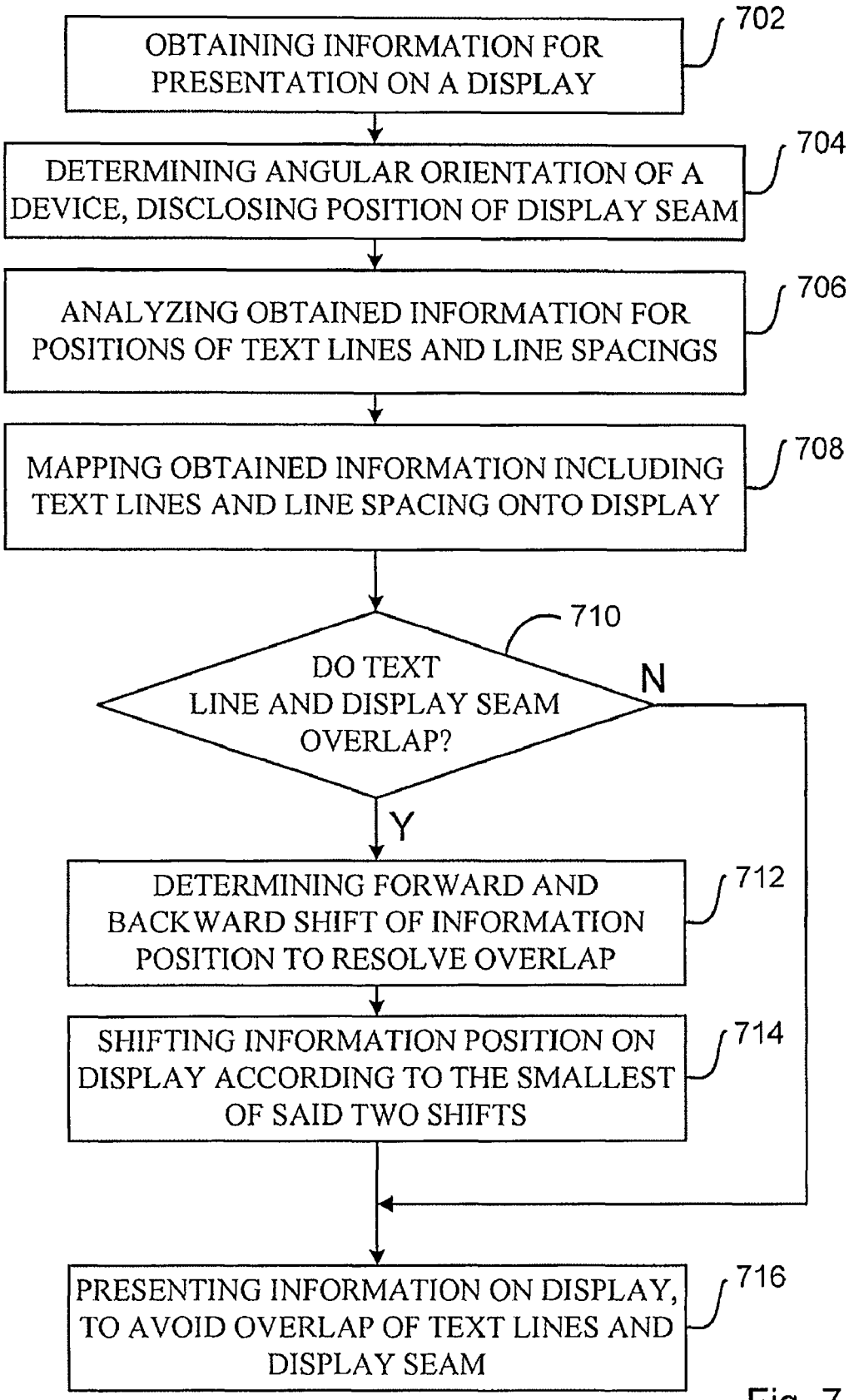
FIG. 7 illustrates method steps of a flow chart according to at least some embodiments of the present invention.

A method for the shifting of information along the envelope surface is presented by method steps as illustrated in the FIG. 7. This method may start with step 702, obtaining information for presentation on a display. The display is thus one example of an information presentation unit, which preferably has a cylindrical shape and forms substantially a full turn, with the seam located within and as defined by two opposing ends of the information presentation unit.

The next step of the method may be step 704, determining the angular orientation of the information presentation device, around the axis of rotation. For the reason that the information presentation unit is arranged fixed on the information presentation device, any orientation of the device reveals the orientation of the information presentation unit as well.

Knowing the angular orientation of the information presentation unit discloses the angular position of the seam of the information presentation unit. The position of the seam around the envelope surface of the device is sought in order to enable provision of information on the information presentation unit avoiding interference by the display seam with the presented information.

The next step may be the step of analyzing obtained information for positions of text lines and line spacing, step 706. Text lines and line spacings are typical examples of content-rich and content-poor information portions, respectively.

The subsequent step is the step of mapping obtained information including text lines and line spacings onto the display, step 708. In this step information may not be presented on the display but may rather be mapped virtually onto the display to enable proper presentation of information.

The following step is the step of determining whether a text line overlaps with the display seam, or not, step 710.

It can be mentioned that information to be presented may be provided to the information presentation unit by a information controlling unit such as a driver. This information can be input to the display at the I/O site, as described above. The information to be presented may thus be incorporated onto the display at this site.

It may also be mentioned that the presentation of information digitally on an information presentation unit, comprises providing information for the entire information presentation unit at the same time, in practise. This is in contrast to an analogue presentation where lines are presented in a sequential manner.

The seam of the information presentation unit inherently follows any rotational motion of the information presentation device, whereas the I/O site may not. For this reason, the relative angular position of the seam of the information presentation unit may not be known per definition in relation to the I/O site.

If it is determined in step 710 that there is a overlap of a text line and the seam of the information presentation unit, such as a display, in step 710, the subsequent step may be step 712 of determining forward and backward shift of information position to resolve the overlap.

In FIG. 6B there are illustrated two directions to shift information to be presented in order to resolve the overlap of the seam and the information. Either a forward or a backward shifting of the information to be presented may be performed. The forward shifting may be defined as shifting the information in a direction such as a further content-rich information portion can be displayed. The backward shifting may be defined as shifting the information in a direction such as the display seam that was to interfere with the content-rich information portion will not interfere upon subsequent presenting on the information on the display. This may be achieved by shifting the information back such that the content-rich information portion falls outside the displaying area of the information presentation unit and the seam overlaps a content-poor information portion. The visible effect of such a shift is thus that the displayed seam does not interfere with the presented information.

After the step of determining forward and backward shift of information required to resolve the overlap in step 712, the step 714 of shifting information position on the display according to the smallest of said two shifts, may follow. In this step, the smallest of the two shifts can be chosen to minimize the step of shifting the information.

Choosing the larger shift for shifting the information may of course alternatively be performed.

It should be mentioned that information presentation device may even increase or decrease the line spacing in size of text information such that an integer number of content-rich information portions can be presented to the information presentation unit, and that at least one seam is covered by line spacings of the text information. In this way, the seam will remain being positioned at a content-poor information portion, without the need to determine whether the is an overlap of a seam and content-rich information portions at every occurrence of a information being over a seam.

Having shifted the information, the step of 716 may be performed, i.e. presenting information on the display, in order to avoid overlap of text line and display seam.

It should be clarified that the information is typically not visibly displayed prior to determining whether there is an overlap or not.

The process of shifting may therefore be difficult to detect by the human eye.

If it is determined in step 710 that the text line and the display seam do not overlap, the following step is step 716 of presenting information onto the display to avoid overlap of text lines and display seam.

As a smaller shifting may preferred to a larger shifting, the smaller shift can be used for shifting of the information, in order to resolve overlap of text line and display seam, being examples of content-rich and content-poor information portions, respectively Having presented a method for controlling presentation of information by referring to the steps of FIG. 7, an information presentation device for presentation of information at least according to some embodiments will now be described.

An information presentation device according to some embodiments of the present invention comprises an information presentation unit and a presentation controlling unit for controlling of the presentation of information onto the information presentation unit.

It should be pointed out that the presentation controlling unit 202 as depicted in FIG. 2, may be adapted to perform the method steps of the flow-chart as presented in FIG. 7. For this reason reference is made to FIG. 2.

The step of obtaining information for presentation on a display, may be performed by the transceiving unit 216. The step of determining the angular orientation of a device, thus disclosing the position of the display seam may be performed by the rotation detection unit 206 in connection with the angle determining and evaluating unit 208, under the control of the control unit 212. The subsequent step of analyzing obtained information for positions of text lines and line spacings, may be performed by the display controlling unit 210 in connection with the memory unit 214, under the control of the control unit 212.

Mapping of the obtained information onto the display can be performed by the display controlling unit in connection with the angle unit 208.

The step of determining whether there is an information and display seam overlap, may likewise be performed by the angle unit 208 in connection with the display controlling unit 210.

It should be reminded that the angle determining and evaluation unit may be called the angle unit.

The determination of forward and backward shift of the information position, in step 712 may be performed by the angle unit 208 again in connection with the display controlling unit 210. Shifting the information position may be performed by the display controlling unit 210 itself, just as the step of presenting information on display may be performed by the display 204.

As indicated above, the control unit 212 may be provided to control the function of the rotation detection unit 206, the angle unit 208, the display controlling unit 210 and the memory unit 214.

A few of these cited steps may however be performed by a unit different from the one described. The control unit may for instance have alternative tasks to perform. As the presentation controlling unit thus can be adapted to perform another method, additional control functions may be provided by the control unit according to at least some embodiments of the present invention.

In the following, presentation of information onto a display having a cylindrical shape is presented.

FIG. 8A schematically presents data information 800, comprising content-rich information portions 802, as well as content-poor information portions 804. The content-rich information portions may typically be information pieces such as text lines.

The content-poor information portions may typically be information pieces such as line spacing, background, and may be characterised by the absence of, in some sense, real information.

However, as line spacing between text lines facilitates the reading of the text lines, it may be argued that line spacing comprises information also. For this reason a content-based approach can be used which is based on the amount of content in a portion of the information to be presented.

In FIGS. 9A-9G, various views along a rotation axis of a cylindrical information presentation device are schematically illustrated.

Figures 8, 9A, 9B, 9C, 9D, 9E, 9F, 9G:
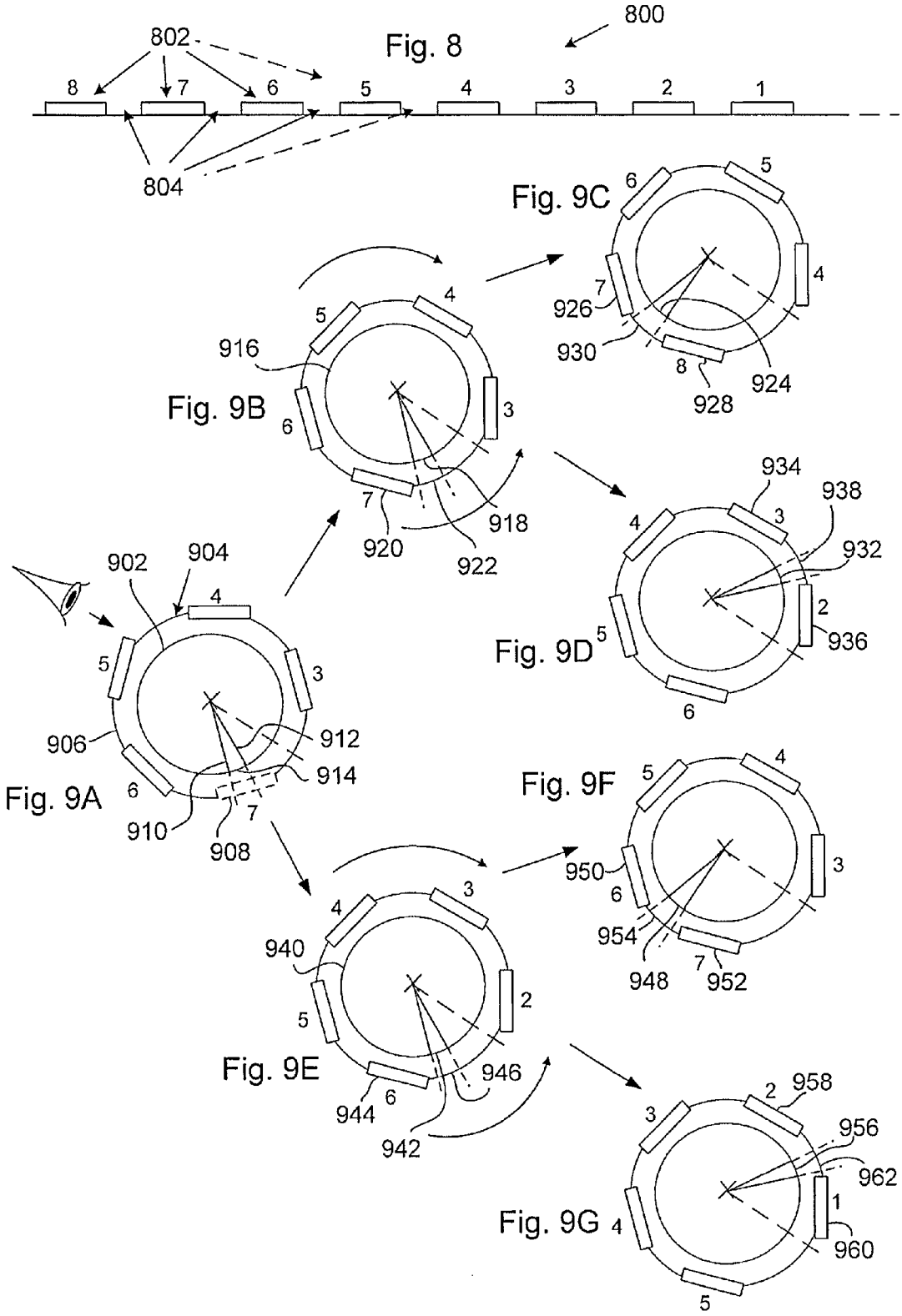
FIG. 8 schematically illustrates one general type of information presentable on an information presentation device.
FIGS. 9A-9G illustrate multiple views along an axis of rotation of an information presentation device according to some embodiments of the present invention.

In FIG. 9A it is illustrated a situation in which information virtually is to be presented on the information presentation unit of the information presentation device. In this situation it is detected that a content-rich information portion and seam of the information presentation unit overlap with each other. For this reason, the information is preferably not presented in this way, but rather that information is shifted in advance of presenting information on the information presentation unit.

The physical entity in the form of the information presentation unit in FIG. 9A is denoted by 902. The information to be presented is denoted with 904. This information comprises both content-poor information portions such as 906, and content-rich information portions such as 908.

The information presentation unit may cover substantially a full turn. In case of a relatively small range or region that is not covered by the information presentation unit, an upper end and a lower end of the information presentation unit may form a seam.

These ends are typically oriented opposite to each other such as to face each other. A first end of the information presentation unit is denoted 910 and a second end of the information presentation unit is denoted 912. The range in between said first and second ends is thus the seam that is denoted as 914 in FIG. 9A.

In FIG. 9A it is further clearly illustrated that the content-rich information portion 908 and the seam 914 overlap.

As such a situation is a problem, this may be resolved. in the following two alternative solutions, which are presented.

One way of resolving such a situation may be to shift the information to be presented clock-wise. This is schematically illustrated in FIG. 9B, in which the information presentation unit is denoted by 916. In FIG. 9B, the seam is denoted 918 and one content-rich information portion 920. It can be understood that the information is shifted a bit in the forward direction such as to circumvent and avoid overlap between content-rich information portions and the display seam.

It is also clearly seen that the information is shifted such as a content-poor information portion 922 is positioned at the position of the seam. This would be to avoid interference by the display seam with the content-rich information portions. It can also be seen that the entire information is shifted a small amount in the clock-wise direction, including the content-rich information portions containing the content 3, 4, 5, 6 and 7, as illustrated in FIG. 9B.

Having resolved the overlap of a content-rich information portion and the seam, the information is rotated together with any rotation of the information presentation device. This is performed as long as the content-rich information does not overlap the display seam.

A clockwise or forward rotation of the information presentation device an angle that corresponds to the angle of one content-rich information portion and one content-poor information portion, provides an information presentation device in FIG. 9C in which there is no information overlap with the display seam. Over the seam 924 is positioned a content-poor information portion 930, whereas content-rich information portions 926 and 928 are positioned around the seam 924 of the information presentation unit.

A counter clockwise rotation of the information presentation device as shown in FIG. 9B, may provide the information presentation device as shown in FIG. 9D, in which again no overlap exists between content-rich information portion and the display seam. The information is positioned such as to present a content-poor information portion at the position of the display seam. As above, the content-rich information portions 934 and 936 do not overlap with the seam 932 but can be properly presented in the information presentation unit.

As alternative way to resolve the overlap situation of content-rich information portion and the display seam of FIG. 9A may be to shift the information counter clockwise, i.e. in a backward direction. The overlap situation as schematically presented in FIG. 9A can be seen to be resolved in FIG. 9E in which the content-rich information portions are shifted a certain rotational angle to resolve the overlap as shown in FIG. 9A. As seen from FIG. 9E, the seam 942 of the information presentation unit does not overlap with the content-rich information portion 944. Rather the seam is positioned as to overlap with a content-poor information portion 946.

This provides the visible impression that the seam 942 does not interfere with the presented information.

Similar to the case in FIG. 9B as presented above, the information presentation device may now be rotated clockwise giving the information presentation device of FIG. 9F or rotated counter clockwise giving the information presentation device of FIG. 9G. The information presentation device of these figures does not show any overlap between any content-rich information portion and the display seam, for the same reason as above, being that the information is rotated along with the information presentation device. In FIG. 9F a content-poor information portion 954 is positioned at the seam 948 of the display, and in FIG. 9G a content-poor information portion 962 may be positioned at the seam 956 of the display. The content-rich information portions 950, 952 and 958, 960 of FIGS. 9F and 9G, respectively, can thus be presented on the information presentation unit, without having the respective seam interfering with the presentation.

It is easy to understand that the embodiments come with some advantages of which a few are:

The presentation of information on cylindrical information presentation units that substantially cover the entire turn is provided in a way such that the seam does not interfere with the presented information. It is an advantage that display seams must not disturb the presented information, according to a number of embodiments of the present invention.

Another advantage of at least some embodiments of the present invention is an improved visual experience of the information to b presented, avoiding disturbance from the seam where two ends of the information presentation unit(s) meet.

In the case of a cylindrical information presentation device comprising several information presentation units, for instance by using non-flexible and non-bendable information presentation units, providing several seams, it is an advantage to present in the information dependent on the positions of respective seam such that content-poor information portions cover the seams, providing an effect of "hiding" the seams for a user.

It is emphasized that the present invention can be varied in many ways, of which the embodiments as presented are just a few examples. These embodiments are hence non-limiting. The scope of the present invention is however, limited by the subsequently following claims.

The invention claimed is:

1. An information presentation device for presentation of information, the information presentation device comprising:

at least one information presentation unit each having a first end and a second end, wherein the first and second ends are provided opposite to each other, and wherein the at least one information presentation unit is arranged to present information to a user, and a presentation controlling unit adapted to be connected to the at least one information presentation unit, said presentation controlling unit being arranged to control the presentation of the information on the at least one information presentation unit in dependence of the position of the first and the second opposing ends of the at least one information presentation unit and in dependence of physical rotation around an axis of rotation of the information presentation device.

2. The information presentation device according to claim 1, wherein the presentation controlling unit further is arranged to detect physical rotation around the axis of rotation of the information presentation device and arranged to provide the presentation of information in dependence of the determined rotation.

3. The information presentation device according to claim 2, wherein the presentation controlling unit further is arranged to determine the position on the information presentation unit at which information pieces are to be presented, in dependence of the detected physical rotation of the information presentation device and in dependence of the position of the first and the second opposing end of the at least one information presentation unit.

4. The information presentation device according to claim 3, for which the information to be presented comprises at least one content-rich information portion and at least one content-poor information portion.

5. The information presentation device according to claim 4, wherein the presentation controlling unit is arranged to determine the position on the information presentation unit, at which position the at least one content-rich information portion of the information is to be presented, in dependence of the detected physical rotation of the information presentation device and in dependence of the position of the first and the second opposing end of the at least one information presentation unit.

6. The information presentation device according to claim 4, wherein the presentation controlling unit is arranged to determine the position on the information presentation unit, at which position the at least one content-poor information portion of the information is to be presented, in dependence of the detected physical rotation of the information presentation device and in dependence of the position of the first and the second opposing end of the at least one information presentation unit.

7. The information presentation device according to claim 6, wherein the presentation controlling unit is arranged to determine the position of the content-rich information portion and the position of the content-poor information portion, in order to present content-rich information portions on the information presentation unit and to position at least one content-poor information portion across the first and second ends of the information presentation unit, in dependence of the detected physical rotation of the information presentation device and in dependence of the position of the first and the second opposing end of the at least one information presentation unit.

8. The information presentation device according to claim 1, wherein one of the at least one information presentation unit has a substantially rotation symmetric shape around the axis of rotation, wherein the at least one information presentation unit covers at least substantially the entire turn around the envelope surface of the rotation symmetric shape, in which the first and second ends of the at least one information presentation unit defines the substantially entire turn.

9. The information presentation device according to claim 1, wherein the presentation controlling unit is arranged to disclose a position on the information presentation unit in relation to the presented information, at which position the presentation controlling unit is arranged to start presenting information, and arranged to stop presenting presented information, in dependence of the rotation of the information presentation device.

10. The information presentation device according to claim 1, wherein said information presentation device is comprised in a mobile phone.

11. A method for controlling presentation of information on at least one an information presentation unit having a first and a second end, where said ends being directed opposite to each other, comprising the steps of:

obtaining information for presentation on an information presentation unit, monitoring a rotational motion around an axis of rotation of an information presentation device, monitoring the position of the first and second ends of the information presentation unit, and presenting information on the information presentation unit in dependence of the monitored rotational motion and in dependence of the monitored position of the first and second ends, such that content-rich information is presented on the information presentation unit and that content-poor information is presented across the first and second ends of the information presentation unit.

* * * * *